US009247816B2

(12) United States Patent
Sorrell

(10) Patent No.: US 9,247,816 B2
(45) Date of Patent: Feb. 2, 2016

(54) TABLE HAVING ADJUSTABLE LEGS

(71) Applicant: Todd Sorrell, Kaneohe, HI (US)

(72) Inventor: Todd Sorrell, Kaneohe, HI (US)

( * ) Notice: Subject to any disclaimer, the term of this patent is extended or adjusted under 35 U.S.C. 154(b) by 0 days.

(21) Appl. No.: 14/681,229

(22) Filed: Apr. 8, 2015

(65) Prior Publication Data

US 2015/0320213 A1 Nov. 12, 2015

Related U.S. Application Data

(60) Provisional application No. 61/990,210, filed on May 8, 2014.

(51) Int. Cl.

| | |
|---|---|
| ***A47B 9/20*** | (2006.01) |
| ***A47B 91/16*** | (2006.01) |
| ***A47B 13/08*** | (2006.01) |
| ***A47B 9/04*** | (2006.01) |

(52) U.S. Cl.

CPC . *A47B 91/16* (2013.01); *A47B 9/04* (2013.01); *A47B 9/20* (2013.01); *A47B 13/083* (2013.01)

(58) Field of Classification Search

CPC ..... A47B 9/00; A47B 9/04; A47B 9/18; A47B 9/20; A47B 13/083; A47B 37/04

USPC ..... 108/147.2, 147.19, 25, 50.12, 192, 19, 108/144.11, 55.3, 55.1, 27; 248/188.2, 248/188.8, 156

See application file for complete search history.

(56) References Cited

U.S. PATENT DOCUMENTS

| | | | | |
|---|---|---|---|---|
| 594,681 | A | 11/1897 | Downs | |
| 2,327,050 | A * | 8/1943 | Kotler | 248/188.4 |
| 2,539,781 | A * | 1/1951 | Heaney | 108/27 |
| 2,795,892 | A | 6/1957 | Lautenbacher et al. | |
| 2,905,513 | A * | 9/1959 | Kane | 108/128 |
| 3,034,153 | A * | 5/1962 | Sargent | 108/25 |
| 3,164,351 | A * | 1/1965 | Rembowski | 248/188.5 |
| 3,433,364 | A * | 3/1969 | Chen | 108/27 |
| 3,855,946 | A | 12/1974 | Bales | |
| 4,199,123 | A * | 4/1980 | Weber et al. | 248/188.2 |
| 4,296,693 | A * | 10/1981 | Archer | 108/50.12 |
| 4,774,892 | A * | 10/1988 | Ballard et al. | 108/55.3 |
| 5,669,312 | A * | 9/1997 | Norton | 108/147 |
| 5,690,303 | A | 11/1997 | Winters | |
| 5,881,979 | A * | 3/1999 | Rozier et al. | 248/188.5 |
| 6,520,459 | B2 * | 2/2003 | Burr | 248/188.4 |
| 6,938,872 | B2 * | 9/2005 | Nygaard | 248/188.8 |
| 7,168,373 | B1 | 1/2007 | Hock | |

* cited by examiner

*Primary Examiner* — Jose V Chen

(74) *Attorney, Agent, or Firm* — Daniel Boudwin; Global Intellectual Property Agency LLC.

(57) ABSTRACT

A table having independently adjustable legs. The table includes a tabletop having a bubble level thereon for allowing a user to determine if the tabletop is level. The tabletop may further include adjustable side rails that can be used to help prevent objects from falling off of the side of the tabletop. A plurality of legs extends from the underside of the tabletop, wherein each leg includes an upper section and a lower section movably positioned therein. A foot is pivotally connected to the lower end of each leg to enable the table to be positioned on uneven surfaces. Thus, the table allows a user to maintain the tabletop in a level orientation on uneven or sloped surfaces.

7 Claims, 3 Drawing Sheets

TABLE HAVING ADJUSTABLE LEGS

CROSS REFERENCE TO RELATED APPLICATION

This application claims the benefit of U.S. Provisional Application No. 61/990,210 filed on May 8, 2014. The above identified patent application is herein incorporated by reference in its entirety to provide continuity of disclosure.

BACKGROUND OF THE INVENTION

Field of the Invention

The present invention relates to tables having adjustable legs. More specifically, the present invention provides a table comprising a tabletop having a plurality of independently adjustable legs. Each leg is extendable and includes a foot pivotally secured on a lower end thereof such that the foot can be stably positioned on uneven surfaces. The tabletop may include a bubble level thereon and a plurality of side rails disposed on the perimeter of the tabletop that can be used to prevent objects from falling off of the table.

Portable tables are commonly used for outdoor events such as picnics, barbeques, tailgates, graduation parties, wedding receptions, and various other events and activities. Outdoor areas often have uneven surfaces and may be sloped. As a result, conventional tables having fixed legs cannot be stably supported on the ground. If the ground is uneven, fewer than all of the legs may engage with the ground, causing the table to be wobbly, which can result in food or items spilling or falling off of the table.

Conventional tables do not provide means for adjusting the legs of the table, making it difficult to balance the table. As a result, some people may place objects under the legs of the table in order to stabilize or level the table. However, this can be inefficient and may not result in a stable and level table. Further, if the table is placed on a slope with all of the legs firmly positioned against the ground, the tabletop will not be level, and the user has no means for leveling the table. Instead, the user must try to find a flat surface, which may be difficult or inconvenient depending upon the location. Thus, a table having adjustable legs for providing a user with a level table for use in outdoor areas is desired.

Devices have been disclosed in the prior art that relate to table leveling devices. These include devices that have been patented and published in patent application publications. Some devices relate to tables having telescopic legs, such as U.S. Pat. No. 7,168,373 and U.S. Pat. No. 3,855,946. Other devices provide alternate means for adjusting the positioning of the tabletop in a level orientation, such as U.S. Pat. No. 5,690,303, U.S. Pat. No. 594,681, and U.S. Pat. No. 2,795,892.

These prior art devices have several known drawbacks. Devices in the prior art provide tables having means for adjusting the orientation of the table, but fail to provide legs having pivotally attached feet. The ability of the feet to pivot allows the feet to rest flush against an uneven surface. Further, the devices in the prior art fail to provide a bubble level for allowing a user to determine if the tabletop is in a level position. Additionally, the devices in the prior art also fail to disclose a tabletop having adjustable side rails for helping to prevent objects from falling from the surface of the tabletop.

In light of the devices disclosed in the prior art, it is submitted that the present invention substantially diverges in design elements from the prior art and consequently it is clear that there is a need in the art for an improvement to existing table devices having adjustable legs. In this regard the instant invention substantially fulfills these needs.

SUMMARY OF THE INVENTION

In view of the foregoing disadvantages inherent in the known types of adjustable tables now present in the prior art, the present invention provides a new adjustable table wherein the same can be utilized for providing convenience for the user when stably positioning a table in a level orientation on an uneven surface or slope.

It is therefore an object of the present invention to provide a new and improved adjustable table device that has all of the advantages of the prior art and none of the disadvantages.

It is another object of the present invention to provide an adjustable table having a plurality of independently adjustable legs affixed to a tabletop.

Another object of the present invention is to provide an adjustable table having adjustable legs wherein the adjustable legs comprise an upper section and a lower section movably inserted within the upper section Yet another object of the present invention is to provide an adjustable table having a plurality of legs with feet pivotally secured thereto.

A further object of the present invention is to provide an adjustable table having a bubble level integrated in the tabletop thereof.

An additional object of the present invention is to provide an adjustable table having a plurality of legs with feet thereon, wherein the feet include a stake for insertion into the ground.

A further object of the present invention is to provide an adjustable table having a tabletop with a plurality of adjustable side rails for preventing objects from falling from the surface of the tabletop.

Another object of the present invention is to provide an adjustable table that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
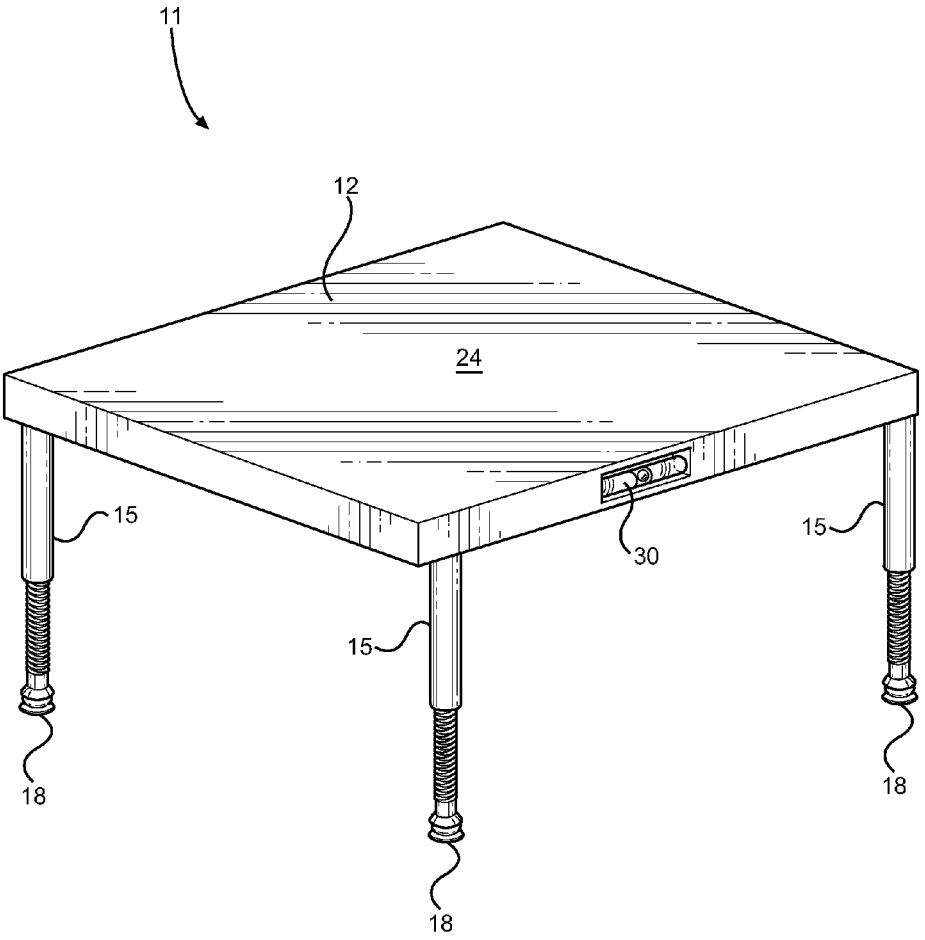
FIG. 1 shows a perspective view of the table having adjustable legs of the present invention.

Reference is made herein to the attached drawings. Like reference numerals are used throughout the drawings to depict like or similar elements of the adjustable table. For the purposes of presenting a brief and clear description of the present invention, the preferred embodiment will be discussed as used for providing a table that can be adjusted so that the tabletop is level when the table is placed on an uneven surface or slope. The figures are intended for representative purposes only and should not be considered to be limiting in any respect.

Referring now to FIG. 1, there is shown a perspective view of the table having adjustable legs of the present invention. The table 11 comprises a tabletop 12 having a planar upper surface 24. The tabletop 12 is preferably square or rectangular, but may include other configurations in alternate embodiments. One or more sides of the tabletop 12 include a bubble level 30 thereon. The bubble level 30 is preferably integrated into the side of the tabletop 12 so that it is flush with the side of the tabletop 12 and does not extend outward therefrom. The bubble level 30 allows a user to determine if the tabletop 12 is arranged in a level, horizontal orientation so that objects can be rested thereon without the risk of falling off the tabletop 12.

A plurality of legs 15 are affixed to the tabletop 12 and extend downward therefrom. The legs 15 are preferably arranged perpendicularly to the tabletop 12 and are arranged on the periphery of the tabletop 12. The legs 15 are adjustable and each leg 15 can be independently adjusted to a desired length. In this way, a user can adjust the legs 15 of the table 11 so that the tabletop 12 is in a level position regardless of the surface on which the table 11 is installed.

Figure 2:
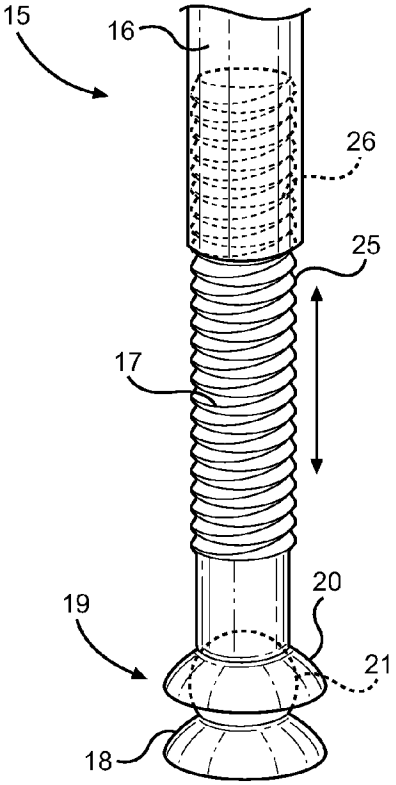
FIG. 2 shows a close-up view of an adjustable leg of the table of the present invention.

Referring now to FIG. 2, there is shown a close-up view of an adjustable leg of the table of the present invention. Each leg 15 is adjustable in length and preferably includes an upper section 16 and a lower section 17. The upper section 16 is tubular and includes a hollow interior volume, and the lower section 17 is inserted into the hollow interior volume of the upper section 16, and is movably positioned therein. Thus, the lower section 17 is extendable from the upper section in order to allow a user to adjust the length of the leg 15. Preferably, the lower section includes threading 25 thereon that is adapted to engage with the threaded interior 26 of the upper section 16 of the leg 15. In this way, the user can incrementally adjust the height of the leg 15 by twisting the lower section 17 so as to withdraw or extend the lower section 17 from the upper section 16.

The lower section 17 of each leg 15 includes a foot 18 pivotally connected to the lower end thereof. The foot 18 is adapted to engage the ground, and is pivotally connected to the lower section 17 so that it can be positioned on an uneven surface. The foot 18 is preferably connected via a ball and socket joint 19. In the illustrated embodiment, the lower end of the lower leg 17 includes a socket 20 in which a ball 21 of the foot 18 is positioned. In this way, the foot 18 can pivot relative to the lower section 17 so that the foot 18 can be disposed on an uneven surface to stabilize the table 11.

Figure 3:
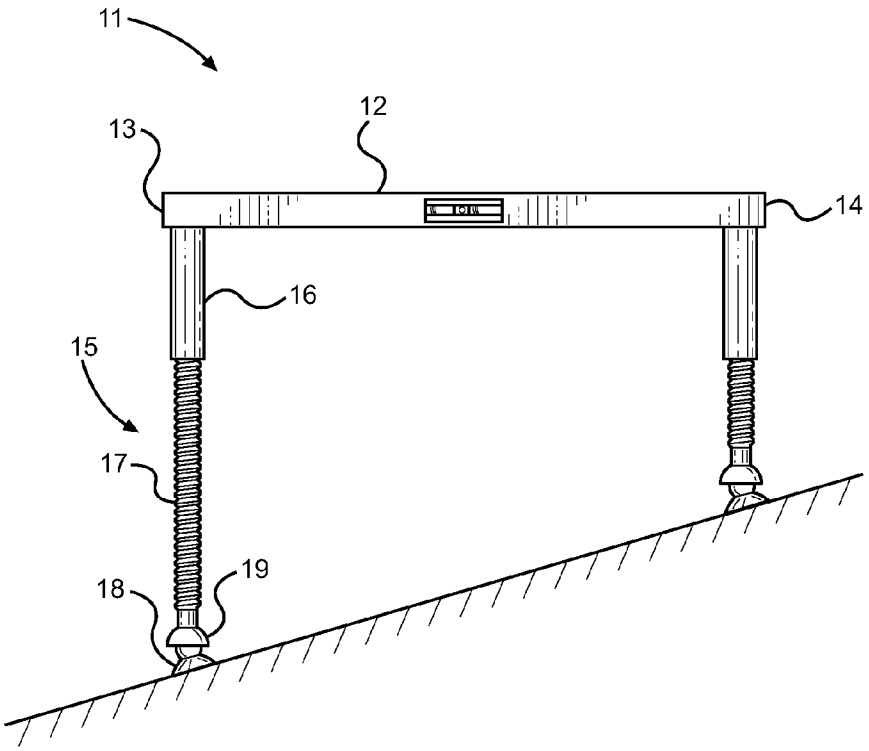
FIG. 3 shows a side view of the table as positioned on a slope.

Referring now to FIG. 3, there is shown a side view of the table as positioned on an incline. In order to position the table 11 in a level position on a slope, the legs 15 can be adjusted in height. For example, a first pair of legs 15 on the table 11 can be extended in length, and a second pair of legs 15 can be shortened, so that the tabletop 12 can remain in a horizontal position when the table 11 is arranged on a slope. The foot 18 thereon can pivot about the joint 19 so that the foot 18 is flush against the sloped surface and is disposed at an angle relative to the lower leg 17. The legs 15 on the upper portion of the slope can be shortened by withdrawing the lower section into the upper section. In this way, a user can independently adjust each leg of the table 11 in order to dispose the tabletop 12 in a level position.

Figure 4:
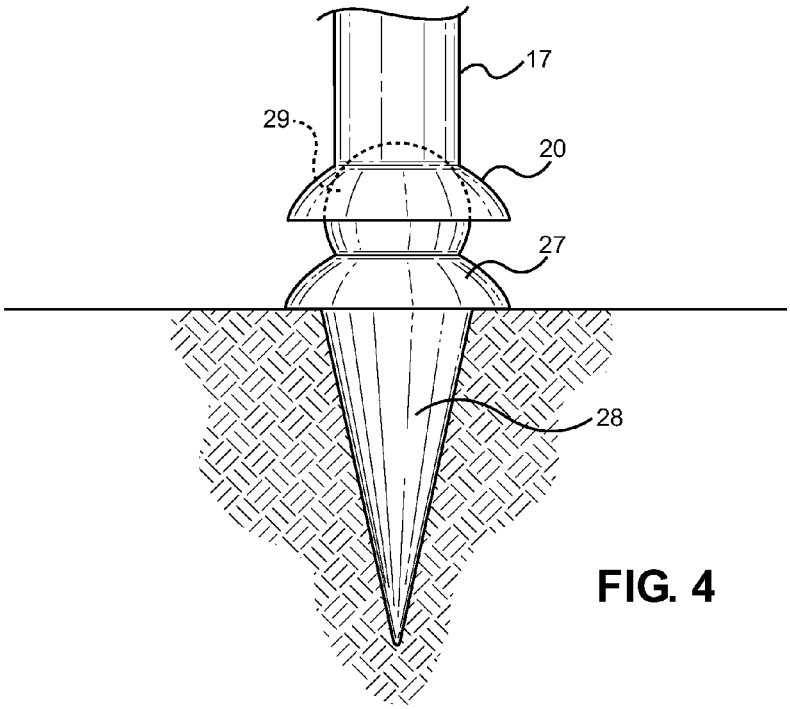
FIG. 4 shows a close-up view of a foot having a stake thereon.

Referring now to FIG. 4, there is shown a close-up view of a foot having a stake thereon. In some embodiments, the lower end of the lower section 17 may include a foot having a stake thereon. The foot comprises a ground engaging portion 27, a ball 29 movably positioned within the socket 20 on the lower section 17 of the leg, and a stake 28 extending downwardly from the ground engaging portion 27. The stake 28 is adapted to be inserted into the ground so as to secure the table in position and to prevent the table from collapsing or otherwise falling over. In some embodiments, the foot can be interchanged such that the user can elect whether to use a ground engaging foot or a foot having a stake thereon. In such embodiments, the ball 29 is removable from the socket 20 so as to allow a user to replace the foot 27.

Figure 5:
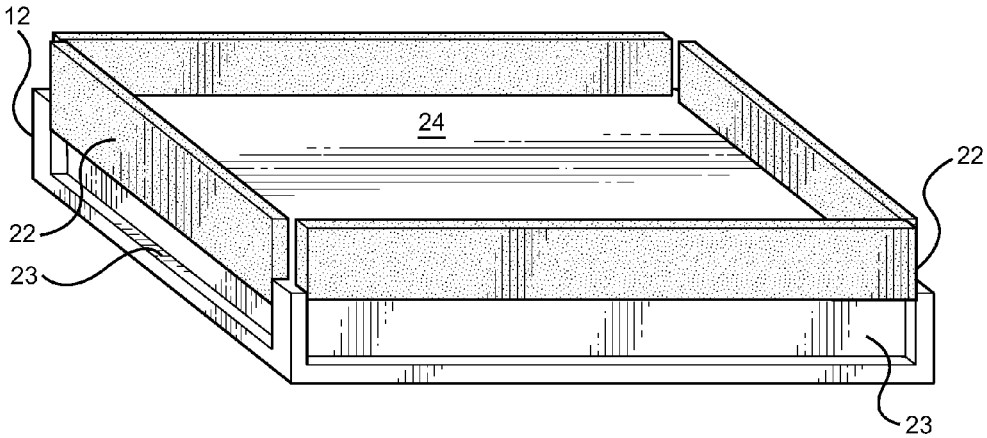
FIG. 5 shows a perspective view of the tabletop having adjustable side rails.

Referring now to FIG. 5, there is shown a perspective view of the tabletop having adjustable side rails. In some embodiments, the tabletop 12 may include one or more side rails 22 disposed on the perimeter of the tabletop 12. The side rails 22 comprise elongated rectangular members. In the illustrated embodiment, each side of the tabletop 12 includes a side rail 22 thereon. The side rails 22 are movably positioned within a channel 23 on the side of the tabletop 12. The channel is adapted to receive the side rail therein so that the sides of the tabletop 12 form a smooth continuous surface. In operation, a user can extend the side rails 22 in an upward direction such that the side rails 22 extend above the surface 24 of the tabletop 12. When not in use, the side rails 22 can be lowered into the channels 23 on the sides of the tabletop 12. The side rails 22 help prevent objects on the surface 24 of the tabletop 12 from falling therefrom.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A table, comprising:

a tabletop having a plurality of legs extending therefrom;

wherein each leg includes an upper section and a lower section;

wherein said lower section is movably positioned within said upper section such that each of said plurality of legs can be extended to a desired length;

a channel cutout from a perimeter edge of the tabletop;

a side rail slidably disposed within the channel, the side rail vertically movable between a retracted position and an extended position;

wherein the side rail forms a continuous surface with the perimeter edge of the tabletop when in the retracted position;

wherein each of said plurality of legs includes a foot pivotally secured to a lower end thereof.

2. The table of claim 1, further comprising a bubble level disposed on said tabletop adapted to allow a user to determine if said tabletop is disposed in a horizontal orientation.

3. The table of claim 1, wherein said foot includes a stake thereon adapted to be inserted into the ground.

4. The table of claim 1, wherein said foot is pivotally secured to a lower end of each of said plurality of legs by means of a ball and socket joint.

5. The table of claim 1, wherein said plurality of legs are telescopic.

6. The table of claim 1, wherein each of said plurality of legs is independently adjustable.

7. The table of claim 1, wherein said lower section includes threading and is adapted to be engaged with threading on an interior of said upper section of said leg.

* * * * *